United States Patent [19]

Friedli et al.

[11] Patent Number: 4,574,019

[45] Date of Patent: Mar. 4, 1986

[54] PROCESS FOR ATTACHING ANODE BLOCKS TO AN ANODE SUSPENSION MEANS

[75] Inventors: Hans Friedli; Edwin Gut, both of Steg, Switzerland

[73] Assignee: Swiss Aluminium Ltd., Chippis, Switzerland

[21] Appl. No.: 689,300

[22] Filed: Jan. 7, 1985

[30] Foreign Application Priority Data

Jan. 18, 1984 [CH] Switzerland ..... 216/84

[51] Int. Cl.[4] ..... B32B 31/16

[52] U.S. Cl. ..... 156/73.6; 156/91; 156/293; 156/330; 156/337; 204/286; 204/297 R; 428/67

[58] Field of Search ..... 156/73.6, 91, 293, 330, 156/337; 204/286, 297 R; 428/67

[56] References Cited

U.S. PATENT DOCUMENTS

| | | | |
|---|---|---|---|
| 1,719,989 | 7/1929 | Moore | 156/73.6 |
| 2,010,934 | 8/1935 | Smith | 156/73.6 |
| 3,576,942 | 5/1971 | Caldor | 156/73.6 X |
| 3,630,808 | 12/1971 | Yasui | 156/73.6 X |
| 4,061,515 | 12/1977 | Willem | 156/73.6 |
| 4,121,994 | 10/1978 | Crippen et al. | 204/286 |
| 4,357,226 | 11/1982 | Alder | 204/286 |
| 4,520,060 | 5/1985 | Blümle | 156/91 X |

FOREIGN PATENT DOCUMENTS 27534 4/1981 European Pat. Off. .

*Primary Examiner*—Robert A. Dawson
*Attorney, Agent, or Firm*—Bachman & LaPointe

[57] ABSTRACT

Carbon anode blocks for use in the fused salt electrolytic process for producing aluminum, are attached to the studs or spades of an anode suspension means by an adhesive mass which is mechanically strong and a good electrical conductor at least at temperatures between 900° and 1000° C. The studs or spades are preheated to 30°-60° C. and/or the anode blocks at least in the region of the holes for the said studs or spades to 25°-40° C. At the latest 60 seconds after inserting the anode suspension means i.e. after immersion of the studs or spades in the cold-poured adhesive mass, the adhesive mass exceeds a temperature of 25° C. The lowering of the studs or the spades is achieved in the shortest possible time by vibrating the anode blocks and/or the anode suspension means. The stabilizing of this arrangement, at least until the adhesive mix has partly hardened, is achieved preferably by spiking or wedging.

13 Claims, 3 Drawing Figures

PROCESS FOR ATTACHING ANODE BLOCKS TO AN ANODE SUSPENSION MEANS

BACKGROUND OF THE INVENTION

The invention relates to a process for attaching carbon blocks, which are employed in the fused salt electrolytic process for producing aluminum, to the iron spades or stud means, of an anode suspension means making use of an adhesive substance which is mechanically strong and is a good electrical conductor at least at temperatures between 900° and 1000° C.

For many years now the attachment of anodes in the aluminum industry has been by casting-in the anode studs or spades with cast-iron or by ramming in a special graphite-containing mass.

In the age of the side-feeding non-hooded reduction cells the method of ramming was often considered the best, economical solution in spite of its disadvantages. Repeated break-down in quality in the ramming mass, its sensitivity to operating temperatures, and the high standard required with respect to tolerances at the anode studs or spades often led to bonding problems and a loss in electrical conductivity at the place of attachment.

In the meantime some important factors have changed. Material and energy prices have risen drastically and more severe environmental laws on fume emission mean that hooded, center or point fed cells are almost the only ones that can be employed today.

As a result the more secure, highly electrically conductive means of attaching anodes has become much more important in recent times, both for economic and for operational reasons.

The alternative casting-in method offers some advantages in this respect, but also presents some weaknesses which have to be overcome:

The desired composition of cast iron used for this purpose must be observed and the melt supervised at all times.

If not properly removed, splashes of metal or overflow metal can reduce metal quality.

Induction furnaces, wiping devices etc. incur higher investment and energy costs.

Described in the European published patent application EP-A No. 27 534 is a carbonaceous contact paste for creating a strong, highly electrically conductive connection between elements at elevated temperatures. The paste which is prepared cold comprises a mixture of epoxy resin and tar as binder, and graphite and metal powder as solid additives. Before use an acid-free hardener, e.g. a polyamine, is added to the mixture. The electrical and thermal conductivity of this contact paste corresponds to the conductivity of carbon blocks and is also suitable for example for bonding anode blocks to the suspension means.

The object of the present invention is to improve the viscosity and the mold filling capacity of the adhesive substance for bonding carbon anode blocks to the iron studs or spades of the anode suspension means, and to do so without causing premature hardening. As such, especially in the case of old, heavily worn studs or spades there should be almost no rejects due to deficiency in bonding and, at the same time, the contact resistance between anode stud or spade and anode block should be less than 50 $\mu\Omega$.

SUMMARY OF THE INVENTION

The foregoing object is achieved by way of the invention in that the studs or spades on the suspension means are heated to a temperature between 30° and 60° C. and/or the anode blocks at least in the region of the holes for the studs or spades to a temperature between 25° and 40° C., and this in such a manner that the temperature of the cold-poured adhesive mass, made up of a mixture of powdered solids and corbonizable binder, exceeds 25° C. at least 60 seconds after inserting the means of anode suspension, the anode blocks are prepared and the studs or spades of the anode suspension means are inserted into the adhesive mass, the anode blocks and/or the anode suspension means are vibrated until the studs or spades come to rest on the bottom of the anode stud or spade holes under the force of their own weight, and, the anode blocks, fitted with the anode suspension means and stabilized in the vertical position, are stored until the adhesive mass has at least partly hardened.

Using the process according to the invention the simple method of adhesive bonding makes it possible to do without the equipment for casting and welding normally needed for casting-in the studs or spades.

Of the several thousand production anode blocks bonded to the anode suspension means using the process according to the invention none has had to be rejected. In cells used for producing aluminum by the fused salt reduction process contact resistance values of 32–48 $\mu\Omega$ have been achieved at the anodes. This means that the aim of obtaining a contact resistance of less than 50 $\mu\Omega$ was achieved, which is advantageous as far as production costs are concerned.

In order to carry out the process optimization is required, not only of the preheating temperature of the anode studs or spades and/or the anode body at least in the region of the holes for the anode studs or spades, but also of the geometry of the said studs or spades and holes. In practice these studs or spades and holes are dimensioned such that two to three kilograms of adhesive paste can be poured in. On inserting the anode rod and vibrating, the adhesive mass reaches the top of the anode block or projects out slightly above it.

The physical and chemical properties of the adhesive mass are of critical importance for the process according to the invention to succeed. In practice adhesive masses which have proved themselves are mixtures of solids, a binder and a hardener.

The contact pastes described in EP-A No. 27 534 are employed. These pastes are made up of a mixture of graphite and metal powder forming the solids, epoxy resin and tar as binder and an acid-free hardener. A mixture which has proved particularly advantageous contains 65–84 wt.% solids, 15–30 wt.% binder and 1–5 wt.% hardener. The metal fraction of the solids, which is important to obtain the low electrical resistance, is usefully of iron, copper or aluminum, or their alloys. The particle size of the metal should be 1 mm at most. Chip-like particle shapes have been found to be particularly suitable.

In the choice of the metal to be employed in the solids fraction attention must be given to the purity of aluminum which is to be produced. If a very high purity aluminum is to be achieved, the use of iron is less favorable and so the non-contaminating aluminum must be employed.

Usefully a frequency in the range 30–100 Hz is employed for the vibration. In practice it has been found that a conventional horizontal vibrating or jarring table can be employed; the anode blocks can be prepared on this table prior to inserting the anode rods. Electro-vibrators with fly wheel discs turn for example with a frequency of 50 Hz and with a mass of 12 kg reach a centrifugal force of 4200N.

After vibrating in order to stabilize the anode rod, a wedge or spike is preferably driven or pressed in between a sidewall of the hole and the stud or spade in it. Special, known pneumatic or hydraulic devices are suitable for this purpose. The spiking takes place in particular with aluminum or iron cylinders which are offset at both sides. As a result of the clamping force produced by the wedging or spiking, the anode blocks are so securely attached to the anode suspension means that, before tha full hardening of the adhesive mass i.e. immediately on completion of the attachment step, the blocks can be hung up and stored.

As with anode blocks which are attached by conventional ramming or casting-in, a collar which is usefully of aluminum can be placed around the studs or spades which project out of the top, and the space inside filled with a carbonaceous mass which calcines during service in the cell. This way the studs or spades are protected from corrosive attack.

BRIEF DESCRIPTION OF THE DRAWINGS

The process for attaching anode blocks to the anode suspension means is explained in the form of a preferred version of the invention with the help of the schematic drawings of vertical cross-sections.

DETAILED DESCRIPTION

Figure 1:
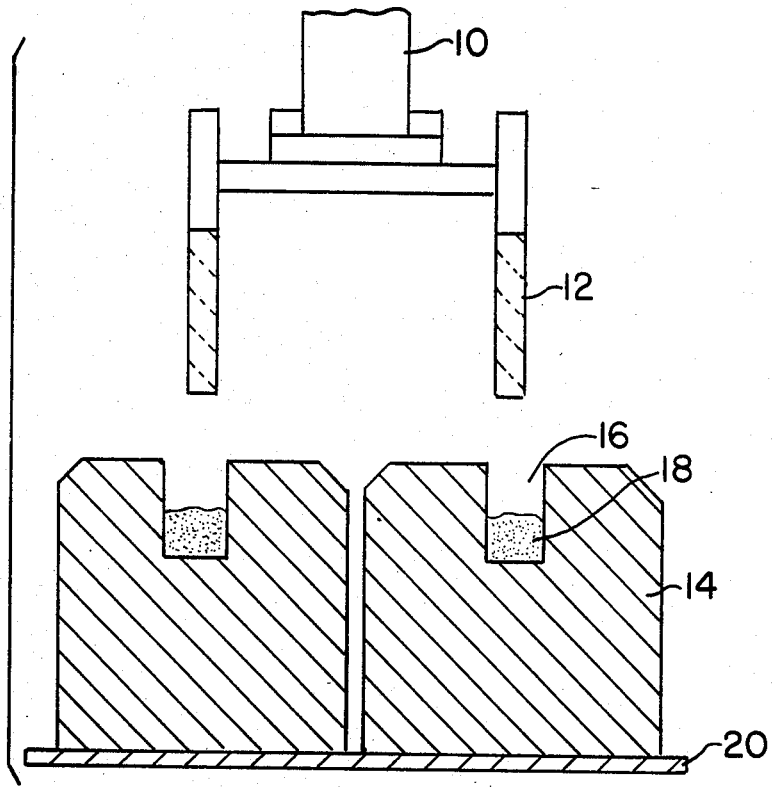
FIG. 1: A preheated anode rod and a pair of prepared anode blocks.

FIG. 1 shows the lower part of an anode suspension means 10 in the form of an anode rod with preheated spades 12. The suspension means 10 is suspended from a holding facility, which is not shown here, by means of which it can be lowered into the two prepared anode blocks 14, each featuring two holes 16 for the spades 12. Previously the adhesive mass 18 of solids, binder and hardener has been poured into the holes 16. The anode blocks 14 rest on a jarring table 20 which is fitted with an electro-vibrator, not shown here.

The anode rod 10 is lowered until it comes to rest on the adhesive mass 18.

Figure 2:
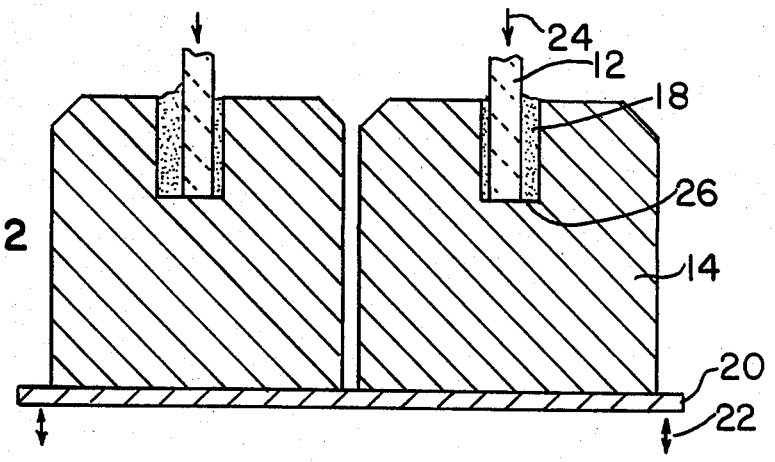
FIG. 2: The anode pair with inserted anode spades.

Then, as indicated in FIG. 2 by arrows 22, the electro-vibrators are actuated, setting the jarring table 20 and thus the anode blocks 14 into corresponding motion. Under the weight of the anode rod 10 the spades 12 dip into the vibrating adhesive mass 18, heat it and, as the arrows 24 indicate, slide down until they reach the bottom 26 of the holes 16. At this point in time, or shortly after, the vibrating action produced by the electro-vibrators is halted.

Figure 3:
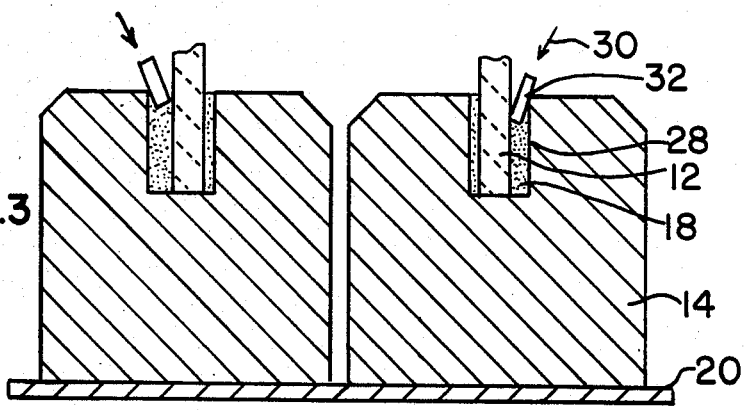
FIG. 3: Anode rod stabilized by spiking two anode blocks.

Illustrated in FIG. 3 is how the spikes 32 are driven between the sidewall 28 of the hole 16 and the spade. The driving action, indicated by the arrow 30, is performed by a hydraulically powered device.

It is self evident that in other versions of the invention studs and stud holes can be used instead of spades 12 and spade holes 16 and wedges instead of spikes 32.

EXAMPLE NO. 1

Two anode blocks weighing approximately 500 kg were prepared on a Würger HV 8/2 jarring table. The blocks were preheated to a temperature between 25° and 40° C.

A supporting rig was used to transport an anode suspension means featuring four iron studs arranged according to the anode dimensions and the holes for the studs; the studs were preheated to a temperature between 25° and 40° C. At the same time 2.5 kg of cold adhesive paste, having the same composition as in example No. 1 in the European patent publication EP-A No. 27 534, was poured into each of the holes in the blocks. Immediately after this the anode suspension means was lowered until the four studs came to rest on the adhesive mixture. Next, the 12 kg heavy fly wheels of the electro-vibrator were actuated and run at a frequency of 50 Hz. Within a few seconds the studs sank to the bottom of the holes under their own weight; the adhesive mass was distributed evenly and filled the hole to the top. After 60 seconds the mass of adhesive mixture had been heated to 25°–28° C., at which stage the vibrator was switched off by an end stop switch of conventional design.

TABLE I

| Preheat temperature | | Temperature of the contact paste 60 seconds after immersion of the studs (°C.) |
|---|---|---|
| Anode block (°C.) | Stud (°C.) | |
| 25 | 23 | 25 |
| 32 | 23 | 27 |
| 40 | 23 | 31 |

The anode suspension means thus fitted with anode blocks were removed from the jarring table to allow the adhesive mix to harden over a space of two days.

EXAMPLE NO. 2

This example was carried out as was Example No. 1. Instead of using anode rods with studs at the end, such rods with spades were employed, the spades being introduced into correspondingly shaped holes. The vibrating was performed at a frequency of 50 Hz via the anode rods.

In this case as the cold adhesive mix was poured the anode blocks and the holes in them were also cold. The spades on the anode rods on the other hand had been preheated to 40°–60° C. Already 50 seconds after immersion of the spades in the adhesive mix the temperature of the mix had risen to 38°–52° C.

TABLE II

| Preheat temperature of spades (°C.) | Temperature of the contact paste 50 seconds after immersing the spades (°C.) |
|---|---|
| 35 | 32 |
| 40 | 38 |
| 45 | 42 |
| 49 | 44 |
| 60 | 52 |

What is claimed is:

1. Process for adhesively attaching carbon anode blocks to stud means of an anode suspension means which comprises: placing an adhesive in holes in the anode block; inserting the stud means into the adhesive; preheating at least one of the stud means and anode block at least in the region of the holes wherein the stud means is preheated to a temperature between 30° and 60° C. and the anode block is preheated to a temperature between 25° and 40° C., wherein the preheating is such that the temperature of the adhesive exceeds 25° C. at least 60 seconds after inserting the stud means; vibrating at least one of the anode blocks and the anode suspension means until the stud means come to rest on the bottom of the holes under the force of their own weight; and at least partially hardening the adhesive.

2. Process according to claim 1 wherein said adhesive is made up of a mixture of powdered solids and carbonizable binder, and wherein said adhesive has good mechanical strength and is a good electrical conductor.

3. Process according to claim 2 wherein use is made of an adhesive mass comprising a mixture of solids, a binder and a hardener.

4. Process according to claim 3 wherein use is made of an adhesive mass comprising a mixture of graphite and metal powder as solids, epoxy resin and tar as binder and an acid-free hardener.

5. Process according to claim 4 wherein use is made of an adhesive mass comprising a mixture of 65–84 wt.% solids, 15–30 wt.% binder and 1–5 wt.% hardener.

6. Process according to claim 1 wherein vibration in a range of 30–100 Hz is employed.

7. Process according to claim 6 wherein said vibration is in the range of 50 Hz.

8. Process according to claim 1 wherein the anode blocks are vibrated on a horizontal jarring table during insertion of the stud means.

9. Process according to claim 1 wherein the assembly is stabilized by placing a wedge between a sidewall of the hole and the stud means after vibration.

10. Process according to claim 9 wherein said wedge is a spike.

11. Process according to claim 9 wherein said wedge is driven between a sidewall and the stud means.

12. Process according to claim 9 wherein said wedge is pressed between a sidewall and the stud means.

13. Process according to claim 1 wherein the adhesive is placed cold in the anode block.

* * * * *